US008083092B2

(12) United States Patent
Hartstock

(10) Patent No.: US 8,083,092 B2
(45) Date of Patent: Dec. 27, 2011

(54) CONTAINER FOR RECEIVING A COSMETIC PRODUCT

(75) Inventor: Karl Hartstock, Ansbach (DE)

(73) Assignee: Geka Brush GmbH, Bechhofen-Waizendorf (DE)

( * ) Notice: Subject to any disclaimer, the term of this patent is extended or adjusted under 35 U.S.C. 154(b) by 357 days.

(21) Appl. No.: 12/147,915

(22) Filed: Jun. 27, 2008

(65) Prior Publication Data

US 2009/0039115 A1 Feb. 12, 2009

(30) Foreign Application Priority Data

Aug. 8, 2007 (EP) ..... 07015561
Apr. 9, 2008 (EP) ..... 08007033

(51) Int. Cl.

| | |
|---|---|
| ***B65D 6/00*** | (2006.01) |
| ***B65D 6/28*** | (2006.01) |
| ***B65D 8/04*** | (2006.01) |
| ***B65D 8/18*** | (2006.01) |
| ***B65D 85/00*** | (2006.01) |

(52) U.S. Cl. ..... 220/662; 220/612; 220/613; 220/665; 220/672; 220/675; 206/459.5

(58) Field of Classification Search ..... 220/612, 220/613, 662, 665, 672, 675; 206/459.5
See application file for complete search history.

(56) References Cited

U.S. PATENT DOCUMENTS

| | | | | |
|---|---|---|---|---|
| 2,626,647 | A * | 1/1953 | Barton | 222/215 |
| 6,585,125 | B1 * | 7/2003 | Peek | 215/381 |
| 2001/0048839 | A1 | 12/2001 | Yoshikazu | |
| 2004/0071491 | A1 | 4/2004 | Hetzel | |
| 2004/0247800 | A1 * | 12/2004 | Yoshitake et al. | 428/1.3 |
| 2006/0027478 | A1 * | 2/2006 | Kaufman et al. | 206/459.5 |
| 2006/0032857 | A1 * | 2/2006 | Stensbol et al. | 220/780 |
| 2007/0048066 | A1 * | 3/2007 | Dumler | 401/130 |

FOREIGN PATENT DOCUMENTS

| | | | |
|---|---|---|---|
| CH | 241676 | A | 3/1946 |
| DE | 10106834 | A1 | 10/2001 |
| FR | 2855378 | A1 | 12/2004 |

* cited by examiner

*Primary Examiner* — Anthony Stashick
*Assistant Examiner* — Madison L Wright
(74) *Attorney, Agent, or Firm* — Browdy and Neimark, PLLC

(57) ABSTRACT

The invention relates to a container for receiving a liquid cosmetic product, in particular a colored cosmetic product for the lips, eyelids, fingernails or the like. A transparent or translucent material is provided as container material. The container is of a two-piece design comprising a first container element and a second container element, wherein the first and the second container element are securely joined together in a liquid-tight manner. The first container element has an inner wall with a profile.

16 Claims, 2 Drawing Sheets

CONTAINER FOR RECEIVING A COSMETIC PRODUCT

BACKGROUND OF THE INVENTION

1. Field of the Invention

The invention relates to a container for receiving a liquid cosmetic product, in particular a colored cosmetic product for the lips, eyelids, fingernails or the like.

2. Background of the Invention

Containers of this type are usually composed of glass, plastic material or metal or a combination of these materials. In order to achieve a pleasing optical appearance and a high-quality impression, the outer surface of the container is conventionally provided with a decoration that is applied by means of complex transfer or printing methods, all the while ensuring that the pleasing appearance of this decoration is preserved even if the container is used several times.

Likewise, it is already known to make visible the color of the contents of the container on the outside by indicating the color on the outside of the container or on the screw cap. Moreover, containers are available, in particular for nail polish, which are completely or partially transparent, thus enabling the color of the cosmetic product in the container to be identified immediately at a glance.

FR 2 855 378 A1, DE 101 06 834 A1, US 2004/0071491 A1 and CH 241 676 A each disclose partially transparent containers for cosmetic sticks such as lipsticks, i.e. for a solid cosmetic product. These containers have profiles on the inner wall which are substantially designed to ensure improved fixing of the received solid stick material.

SUMMARY OF THE INVENTION

On this basis, it is the object of the invention to create a new and therefore spectacular and attractive embodiment of a container of the above type which enables the color of the liquid cosmetic product in the container and if desired additional shiny effects thereof to be simultaneously identified from the outside.

This object is achieved according to the invention by a container for receiving a liquid cosmetic product, in particular a colored cosmetic product for the lips, eyelids, fingernails or the like, wherein a transparent or translucent material, in particular a plastic material, is provided as container material; a two-piece design is provided, the two-piece design comprising a first container element and a second container element, wherein the first and the second container element are securely joined together in a liquid-tight manner; and at least the first container element has an inner wall with a profile.

The two container elements are in particular separate components, wherein each of which may preferably be fabricated independently from the other before they are subsequently joined together to form the inventive container. The liquid-tight connection between the first and the second container element is in particular a permanent one that is in particular chemically and physically resistant to the liquid cosmetic product to be filled into the container. This ensures that the container remains tightly sealed at this joint even with the cosmetic product inside, and even if the cosmetic product, which may also be nail polish or nail polish remover for example, contains chemically aggressive ingredients.

At the same time, the two-piece design of the container allows the creation of the inventive profile on the inner wall, the profile having a particularly pleasing optical effect that is impossible to achieve with a one-piece design. Due to the transparent or translucent container material, which is also provided according to the invention, this inner profile is visible on the outside both in the unfilled and in the filled state. Especially in connection with the cosmetic product in the container, the profile of the inner wall creates an interesting optical effect without however impairing the use on the outside.

According to a favorable embodiment, each of the first container element and the second container element is an injection-molded plastic part. Alternatively, they may also be extrusion-blown or injection-blown plastic bodies. Fabrication of these components is particularly easy and cost-effective, the inner profile simultaneously enabling a high-quality impression to be obtained.

According to another favorable embodiment, the second container element is a bottom element or an upper shoulder element having a container opening. This way, a favorable joint is obtained between both container elements. Moreover, the two container elements then preferably have no undercuts which might cause difficulties during the injection-molding process in particular when removing the parts from the mold.

According to another favorable embodiment, the secure and liquid-tight joint between the first and the second container element is a welded joint. Alternative joints such as an adhesive joint are however also conceivable. This way, a permanently liquid-tight joint may be obtained in an easy and cost-effective manner.

In another favorable embodiment, it is provided that the inner wall has at least one inner-wall partial area with a higher roughness as compared to that of the remaining inner wall, the roughness depth thereof being in particular between 1.5 and 85 μm, preferably between 12 and 25 m. Inner profiles within the scope of the present invention also include areas of this type, i.e. those having a different roughness. They may be applied to the inner wall on their own or also together with other profiles. The partially increased roughness of the inner wall may preferably be achieved using an injection mold for fabricating the container element, wherein parts of the mold wall of the injection mold are not or less polished. Alternatively, parts of the mold wall of the injection mold may be roughened to a desired degree, e.g. by means of a laser-beam treatment. Container elements fabricated using such injection molds have the optically pleasing, partially increased roughness on their inner walls which is also visible on the outside. From the outside, this roughness is perceived as a matte finish or a gray shade that deviates from the uniform basic color shade of the cosmetic product that shines through the container and is thus visible on the outside.

According to another favorable embodiment, a label readable from the outside or a logo visible from the outside is applied to the inner wall. These label or/and logo elements may again preferably be formed by a partially different roughness of the inner wall. The application of these label or/and logo elements on the inner wall is particularly permanent. In the filled state of use of the container, these elements are not accessible from the outside, thus preventing them from being removed accidentally or intentionally. In contrast to imprints or stampings applied to the outside, these label or/and logo elements applied to the inside are not subject to the risk of being scratched off, wiped away or otherwise removed even if the container is used for a longer period of time. Furthermore, they are protected against unwanted or even wrongful removal of for example a mark of origin.

In another favorable embodiment, it is provided that the profile of the inner wall is formed by rib-like inner projections that considerably modify the refraction properties of the container wall and are therefore distinctly visible on the outside.

For instance, the ribs may extend in a longitudinal direction. They may have a cross-section that is wedge-shaped or rounded in a bead-like manner when seen in a direction perpendicular to the longitudinal direction, i.e. they may have more or less sharp edges which create a more or less linear appearance when seen from the outside. Likewise, this results in an interesting optical impression on the outside.

The transparent container material may have a Haze factor of <5% within the scope of the invention. This ensures a particularly high amount of transparency which provides a good view of the cosmetic product in the container and of the inner profile.

According to another favorable embodiment, the profile is formed such that the contour of the inner wall has another cross-sectional geometry than an outer wall. This allows very impressive effects to be obtained.

In another preferred embodiment, it is provided that the inner wall has a polyangular cross-section when seen in a direction perpendicular to a longitudinal axis, wherein in particular a transition between adjacent areas of the inner wall having polyangular cross-sections may be formed by sharp edges such that the polygon structure is very clearly visible on the outside. An outer wall preferably has a round or oval cross-section when seen in a direction perpendicular to the longitudinal axis. Thus, a particularly clear contrast is obtained between the different cross-sectional contours of the inner and the outer wall which creates an interesting effect.

According to another favorable embodiment, the first container element widens in the direction towards the second container element. This widening may occur either on the inner wall or on an outer wall or on both inner and outer wall, making it easier for the parts to be removed from the mold. This widening is in particular obtained by a slight conicity.

According to another favorable embodiment, at least the first container element has a decorative coating on an outer wall. This decorative coating is in particular applied to the outer wall in a way as to be aligned relative to the profile of the inner wall, thus enabling the decorative coating to form a frame for the inner profile, for example. Again, this results in an interesting optical effect, in particular if the inner profile is formed by label or/and logo elements which are then surrounded by the frame of the outer decorative coating. This decorative coating is preferably applied by stamping, in particular by hot-foil stamping.

According to another favorable embodiment, at least one of the two container elements, preferably the second container element, is provided with a marking. The marked container element may in particular be the bottom element or the shoulder element of the container. A structural or three-dimensional marking of the bottom or shoulder element is less noticeable than a marking on the main part of the container which also forms the circumferential surface area for the receiving volume. Moreover, such a marking of the bottom or shoulder element does not impair the use of the container. The marking is preferably a registration serving to determine and/or control the position during a fabrication step in which the container, in particular the first container element thereof, is provided with a decorative coating. The marking is preferably a structural or three-dimensional one, for example a projection or a recess. The marking allows the decorative coating to be positioned on the container in a defined and precise manner. This is especially advantageous if the outer decorative coating is to be applied at a defined spatial relation to the inner profile.

The two-piece container may be fabricated by injection molding, wherein the two elements thus fabricated are joined together in the shoulder or bottom area of the container by means of a welded joint formed in particular by ultrasonic or laser welding, a fit which is in particular a press fit or a lock-in press fit, or another suitable liquid-tight connection.

The following is a more detailed description of a preferred embodiment of the invention by means of the drawing.

BRIEF DESCRIPTION OF THE DRAWINGS

Equivalent parts are denoted by the same reference numerals in FIGS. 1 to 6.

DESCRIPTION OF THE PREFERRED EMBODIMENTS

Figure 2:
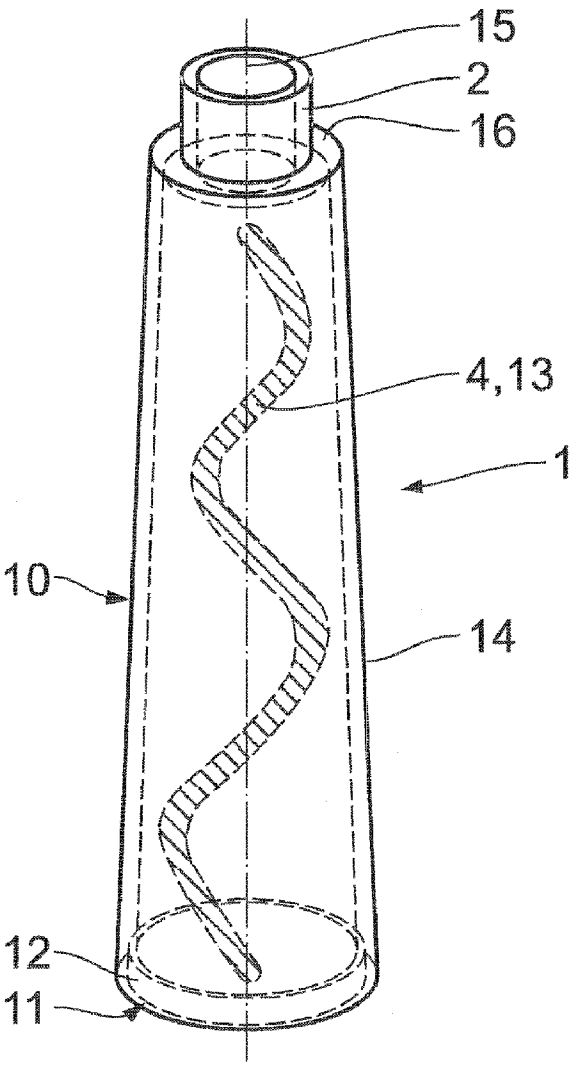
FIG. 1 and FIG. 2 show embodiments of two-piece containers according to a first embodiment with a partial roughening of the inner wall.

The drawing shows one container 1 each that is composed of a transparent material such as a highly transparent plastic material known by its commercial name "EASTMAN GLASS POLYMER". In order to obtain the desired optical effects, the wall thicknesses of the containers 1 exceed those of conventional round containers, for instance 2 to 5 mm. Each of the containers 1 is intended to receive a liquid, in particular a colored cosmetic product such as lip gloss, nail polish, eye shadow or the like.

In the displayed embodiments, each of the containers 1 is of a two-piece design. Each of them comprises a basic container body 10 acting as first container element, the basic container body 10 surrounding the actual receiving space for the liquid cosmetic product, as well as a container bottom 11 acting as second container element. The basic container body 10 and the container bottom 11 are welded together such that a permanently secure and, above all, liquid-tight joint 12 is obtained.

All containers 1 have a profile 13 at an inner wall 5 of the basic container body 10, the profile 13 being visible from the outside.

In the displayed embodiments, the containers 1 each have a round outer shape, i.e. outer wall 14, and taper conically upwards in the direction of a longitudinal axis 15. If required, decorations may easily be applied to the outside of such configurations, for example by means of hot foil stamping. This tapering design is provided on the respective outer wall 14 of the containers 1 but also in particular on the respective inner wall 5 thereof, which makes it easier for the injection-molded basic container body 10 to be removed from the mold. The core of the injection mold may then be removed from the basic container body 10 very easily in the direction of the container bottom to be attached afterwards.

A shoulder 16 is formed on the upper side of the container 1, the shoulder being connected to a narrower neck 2 to which a cap of any desired shape may be attached, for instance a screw cap that follows the outer geometry of the container 1.

Figure 1:
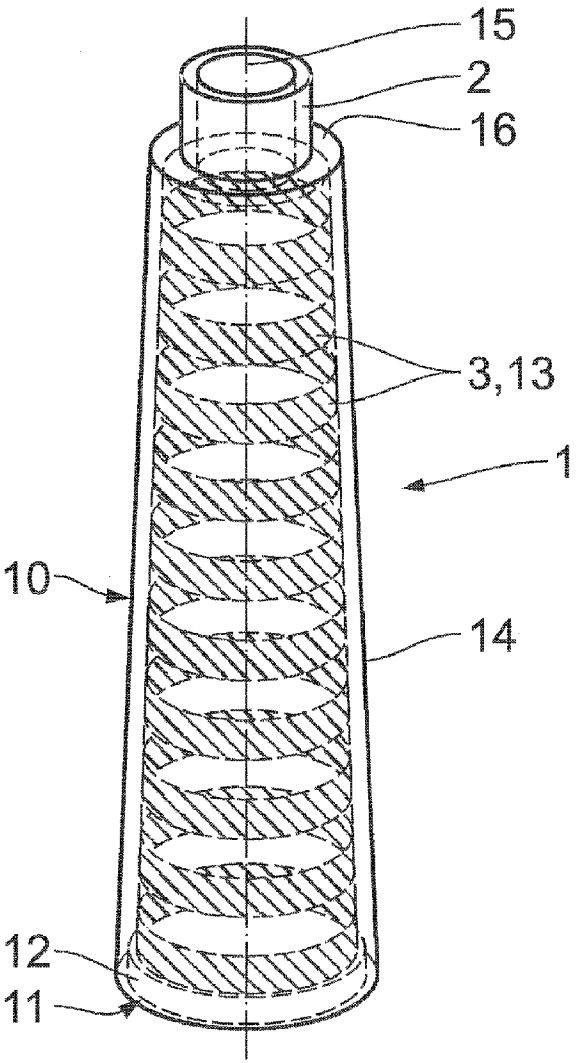

In the embodiment according to FIGS. 1 and 2, part of the core of the injection mold of the basic container body 10 is not polished so as to achieve a matte finish in this area when the container 1 is finished, this matte finish being the result of the increased surface roughness.

The embodiment according to FIG. 1 shows stripes 3 having a matte finish that extend about the longitudinal axis 15 at a distance from each other, thus forming the profile 13. The embodiment according to FIG. 2 is provided with a wavy line 4 in a matte finish that forms the profile 13. Alternatively, the roughened surface of the inner wall 5 may also be designed such as to obtain a label readable from the outside and/or a logo visible from the outside, for instance a mark of origin such as a company or product logo.

Figure 4:
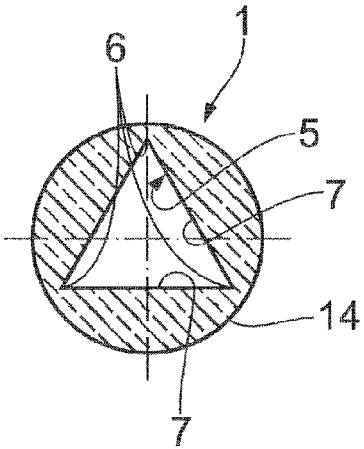
FIG. 4 shows a cross-section perpendicular to the longitudinal axis through the container according to FIG. 3.
Figure 3:
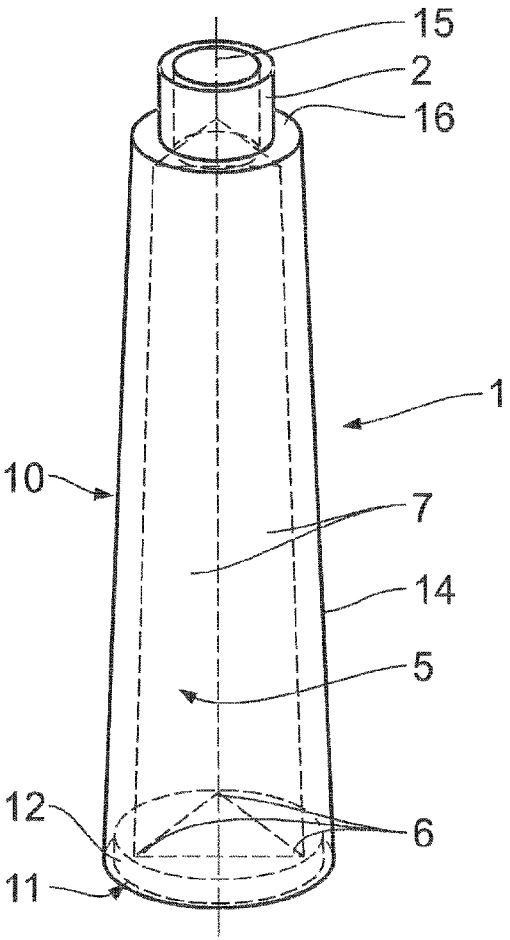
FIG. 3 shows an embodiment of a two-piece container according to a second embodiment with a polyangular inner-wall design.

FIGS. 3 and 4 show an embodiment in which the inner wall 5 of the container 1 has a triangular cross-section with relatively sharp, acute-angled transitions 6 between two adjacent triangular areas 7, wherein this transitional area 6 or the edge, respectively, thus formed is clearly visible on the outside. In this embodiment, the inner profile 13 is formed such that the contour of the inner wall 5 has another cross-sectional geometry than the outer wall 14. When seen in the direction perpendicular to the longitudinal axis 15, the inner wall 5 has a polyangular cross-section which is triangular in the embodiment. The outer wall 14 on the other hand has a round cross-section when seen in the direction perpendicular to the longitudinal axis 15.

Figure 5:
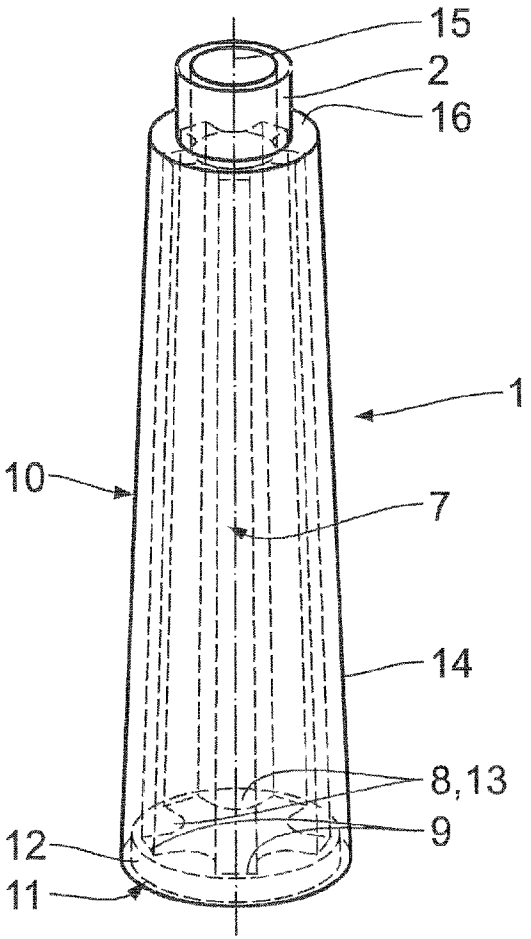
FIG. 5 shows an embodiment of a two-piece container of a third embodiment with longitudinal ribs at the inner wall.
Figure 6:
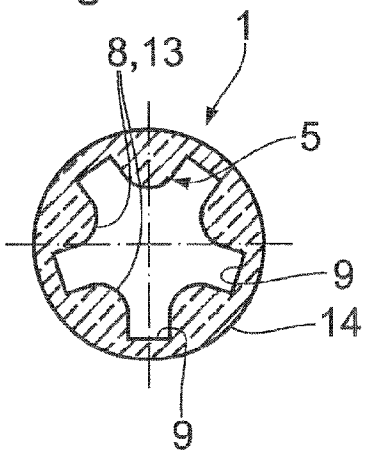
FIG. 6 snows a section perpendicular to the longitudinal axis through the embodiment according to FIG. 5.

In the embodiment shown in FIGS. 5 and 6, the container 1 has a plurality of bead-like, rounded ribs 8 at its inner wall 5, the ribs 8 extending into the inner wall 5 at 9 at approximately right angles. Thus, when seen from the outside, an interesting design is achieved that is shown in FIG. 5. Likewise, the inner profile 13 of this embodiment is obtained by means of the ribs 8 such that the contour of the inner wall 5 has a different cross-sectional geometry than the outer wall 14.

What is claimed is:

1. A container for receiving a liquid cosmetic product comprising:

a) a container body formed of a material that has one of the following properties:

transparency; or translucency;

b) the container body having a two-piece design, the two-piece design comprising a first container element (10) and a second container element (11), wherein the first and the second container element (10, 11) are securely joined together in a liquid-tight manner at a secure and liquid-tight joint (12); and c) at least the first container element (10) has an inner wall (5) with a structuring (3, 4), said inner wall comprising a first inner-wall partial area and a second inner-wall partial area; and d) the structuring of the first inner-wall partial area (3, 4) has a higher surface roughness than the second inner-wall partial area.

2. A container according to claim 1, wherein both the first container element (10) and the second container element (11) are injection-molded plastic parts.

3. A container according to claim 1, wherein the second container element is one of the group comprising a bottom element (11) and an upper shoulder element having a container opening.

4. A container according to claim 1, wherein the secure and liquid-tight joint (12) between the first and the second container element (10, 11) is a welded joint.

5. A container according to claim 1, wherein a roughness depth of the first inner-wall partial area (3, 4) amounts to between 1.5 and 85 μm.

6. A container according to claim 1, wherein a roughness depth of the first inner-wall partial area (3, 4) amounts to between 12 and 25 μm.

7. A container according to claim 1, wherein the inner wall (5) has a polyangular cross-section when seen in a direction perpendicular to a longitudinal direction (15), and an outer wall (14) has a cross-section that has one of the following shapes when seen in a direction perpendicular to the longitudinal direction (15):

round;

oval.

8. A container according to claim 7, wherein a transition (6) between adjacent areas (7) of the inner wall (5) having a polyangular cross-section is formed by sharp edges.

9. A container according to claim 1, wherein the first container element (10) widens in a direction towards the second container element (11).

10. A container according to claim 9, wherein both the inner wall (5) as well as an outer wall (14) of the first container element (10) widen in the direction towards the second container element (11).

11. A container according to claim 1, wherein the material provided as the container is transparent and has a Haze factor of <5%.

12. A container for receiving a liquid cosmetic product comprising:

a) a container body formed of a material that has one of the following properties:

transparency; or translucency;

b) the container body having a two-piece design, the two-piece design comprising a first container element (10) and a second container element (11), wherein the first and the second container element (10, 11) are securely joined together in a liquid-tight manner; and c) at least the first container element (10) has a container wall comprising an inner wall surface (5) and an outer wall surface (14), the inner wall surface being provided with a structuring (6, 7, 8, 13); and d) the structuring (6; 7; 8; 13) is formed such that a contour of the entire inner wall surface (5) has a cross-sectional geometry different than a cross-sectional geometry of the entire outer wall surface (14), the cross-sectional geometry of the inner wall surface and the outer wall surface being configured such that at any radius from a central longitudinal axis to the outer wall surface, a distance between the inner wall surface and the outer wall surface is constant along an entire length of the first container element.

13. A container according to claim 12, wherein the structuring (13) of the inner wall (5) is formed by rib-like inner projections (8).

14. A container according to claim 13, wherein the rib-like inner projections (8) extend in a longitudinal direction (15).

15. A container according to claim 14, wherein the rib-like inner projections (8) have a cross-section that has one of the following shapes when seen in a direction perpendicular to a longitudinal axis (15):

wedge-shaped;

rounded in a bead-like manner.

16. A container for receiving a liquid cosmetic product comprising:

a) a container body formed of a material that has one of the following properties:

transparency; or translucency;

b) the container body having a two-piece design, the two-piece design comprising a first container element (10) and a second container element (11), wherein the first and the second container element (10, 11) are securely joined together in a liquid-tight manner; and c) at least the first container element (10) has a container wall comprising an inner wall surface (5) and an outer wall surface (14), the inner wall surface being provided with a structuring (6, 7, 8, 13); and d) the structuring (6; 7; 8; 13) is formed such that a contour of the entire inner wall surface (5) has a cross-sectional geometry different than a cross-sectional geometry of the entire outer wall surface (14), the inner wall surface and the outer wall surface being configured such that only one of the inner wall surface and the outer wall surface is conical whereby the container wall has a thickness that varies constantly along an entire length of the container wall.

* * * * *